US006573466B1

(12) United States Patent
Rapp et al.

(10) Patent No.: US 6,573,466 B1
(45) Date of Patent: Jun. 3, 2003

(54) ELECTRICAL SWITCH

(75) Inventors: Klaus Rapp, Bad Dürrheim (DE); Rainer Kizele, Tuttlingen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 09/763,592

(22) PCT Filed: Nov. 9, 1999

(86) PCT No.: PCT/DE99/03560

§ 371 (c)(1),
(2), (4) Date: Feb. 26, 2001

(87) PCT Pub. No.: WO00/28562

PCT Pub. Date: May 18, 2000

(30) Foreign Application Priority Data

Nov. 9, 1998 (DE) ..... 198 51 514

(51) Int. Cl.[7] ..... H01H 19/06
(52) U.S. Cl. ..... 200/302.3; 200/302.2
(58) Field of Search ..... 200/302.3, 302.1, 200/302.2, 339

(56) References Cited

U.S. PATENT DOCUMENTS

| | | | | |
|---|---|---|---|---|
| 3,928,742 A | * | 12/1975 | Rule | 200/302 |
| 5,477,024 A | * | 12/1995 | Share et al. | 219/121.69 |
| 5,626,222 A | * | 5/1997 | Auilera | 200/305 |
| 5,642,806 A | * | 7/1997 | Karakimas | 200/557 |
| 5,671,840 A | * | 9/1997 | Glicksman | 200/302.3 |
| 5,788,059 A | * | 8/1998 | Jahangiri | 200/302.3 |
| 5,990,431 A | * | 11/1999 | Wright | 200/302.3 |

FOREIGN PATENT DOCUMENTS

| | | | |
|---|---|---|---|
| DE | 1 806 782 | | 8/1970 |
| DE | 94 03 729 | | 5/1994 |
| DE | 196 46 474 | A1 | 5/1998 |
| DE | 197 05 068 | A1 | 8/1998 |
| EP | 0 404 718 | A2 | 12/1990 |
| FR | 2 042 069 | | 2/1971 |
| GB | 2 187 891 | A | 9/1987 |
| JP | 9171595 | * | 6/1997 |

* cited by examiner

*Primary Examiner*—Karl D. Easthom
*Assistant Examiner*—Lisa Klaus
(74) *Attorney, Agent, or Firm*—Morgan, Lewis & Bockius LLP

(57) ABSTRACT

The invention relates to an electrical switch with a housing (2). In the housing (2) there is a contact system (3), to which a switching effect can be applied by means of an actuating member (6) which is arranged in an opening (5) on the housing (2) and partly protrudes out of the housing (2). The part of the actuating member (6) protruding out of the housing (2) as well as the opening (5) in the housing (2) is covered by a cap (9) allowing the movement of the actuating member (6). The cap (9) has a cover of a hard material and a sleeve-like part (11) of a flexible material, designed in the manner of a bellows. The cover, designed essentially in the manner of a planar surface (10), is arranged on the part of the actuating member (6) protruding out of the opening (5) in such a way that the actuating member (6) can be moved via a side of the cover facing the user. One end of the sleeve-like part (11) is fastened along a peripheral edge on the side of the planar surface (10) of the cover facing away from the user. The other end of the sleeve-like part (11) protrudes laterally beyond the surface (10) of the cover, the protruding other end of the sleeve-like part (11) being arranged on a region (12) of the housing (2) surrounding the opening (5).

17 Claims, 6 Drawing Sheets

ELECTRICAL SWITCH

BACKGROUND OF THE INVENTION

1. Field of the Invention

The invention relates to an electrical switch.

2. Discussion of the Related Art

In electrical equipment used in aggressive operating conditions, precautions have to be taken to protect the electrical switch against harmful influences which impair its functional capability. Such harmful influences may be, for example, moisture, dust or the like.

Such switches have a housing in which the contact system is located, and an actuating member which is arranged in an opening on the housing, partly protrudes out of the housing and is provided for acting on the contact system with a switching effect. For protecting the switch against harmful influences, arranged on the switch is a cap of elastic material, which covers the part of the actuating member protruding out of the housing as well as the opening in the housing. On account of its elasticity, the cap allows the movement of the actuating member for switching the contact system.

A disadvantage of the known cap for protecting the switch against contaminants is that, when the switch is actuated, a relative movement takes place between the cap and the actuating member. As a result, destruction of the cap may occur after a certain period of use, in particular the friction between the cap and the actuating member may lead to cracks in the cap, so that the cap can no longer perform its protective function. Furthermore, it is disadvantageous that, on account of the elasticity of the cap, it is only possible with difficulty to ascertain visually which switching state the actuating member assumes.

DE 196 46 474 A1 further discloses an electrical switch with a cap which has a cover of a hard material and a sleeve-like part of a flexible material, designed in the manner of a bellows. The cover of the cap is of a pot-shaped design on the side facing away from the user and is arranged on the part of the actuating member protruding out of the opening in such a way that the sleeve-like part is covered by the cover. The actuating member can be moved via the side of the cover facing the user, for switching the contact system. This design of the cap requires that the switch is of a large overall form. Moreover, there is the risk of contaminants accumulating in the pot-shaped part of the cover and penetrating into the housing of the switch.

SUMMARY OF THE INVENTION

The invention is based on the object of further developing the electrical switch in such a way that the protection against ingress of contaminants into the switch is improved. Furthermore, a small switch of this type is to be provided.

A rigid plastic is expediently chosen as the material for the planar surface of the cover and a flexible plastic, such as a thermoplastic elastomer, is expediently chosen for the sleeve-like part. It is then appropriate to mold one end of the sleeve-like part on the planar surface of the cover for fastening in the manner of a two-component part. As a result, the risk of contaminants penetrating between the cover and the sleeve-like part at the particularly stressed fastening location is very low.

The planar surface of the cover may be fastened on the actuating member on the side facing away from the user by means of catch and/or snap elements. As a result, simple mounting is made possible merely by fitting the cap on, with the advantage that impairment of the protective function of the cap is not to be feared. The other end of the sleeve-like part, facing the housing, may be designed such that it can be slipped over a flange face of the housing in a simple manner or else be fitted on by means of a frame-like base.

For additionally improving the sealing of the mounting opening of an item of equipment in which the switch is fitted, a sealing lip may be arranged at the other end of the sleeve-like part or on the frame-like base. Furthermore, it is also possible to fit the switch into the mounting opening in such a way that part of the sleeve-like part on the cap at the same time seals the mounting opening into the interior of the equipment. As a result, the ingress of contaminants into the equipment is prevented in a simple manner merely by use of the switch, without additional sealing means for the equipment being necessary.

The switch according to the invention can also be designed in a simple way such that it can be illuminated, though the protection against ingress of contaminants is completely retained. For this purpose, it is sufficient to produce the planar surface of the cover from a plastic which is at least partly transparent to light in the visible spectral range. The lighting means may be arranged in a chamber of the actuating member, the chamber being covered by the planar surface of the cover. To increase the light yield in the case of a switch which can be illuminated in such a way, it is then also appropriate to produce the sleeve-like part from a plastic which is essentially opaque to light in the visible spectral range.

The advantages achieved by the invention consist in particular in that improved protection against ingress of contaminants into the interior of the housing of the switch, which may lead to impairments of the contact system located in the housing, is achieved. The risk of the cap being damaged during the period of use of the switch is greatly reduced by the hard planar surface of the cover of the cap, serving as an actuating surface. In addition, simultaneous protection of the electrical equipment, in the wall of which the switch can be fitted in a mounting opening, against ingress of contaminants through the mounting opening can also be achieved. Furthermore, the improvement in the protection for the switch also has the effect of considerably improving its service life.

In comparison with the previously used elastic caps, in which the respective switching position of the actuating member can be visually ascertained only with great difficulty, in the case of the switch according to the invention the switching position assumed by the actuating member can be easily seen. In the case of an illuminated switch, the light of the illumination is attenuated to a lesser extent than is the case with the previous elastic caps.

On account of the hard planar surface of the cover of the cap, serving as the actuating surface, the switch according to the invention can be actuated better by the user. The actuating feeling corresponds to that of a switch with which the user acts directly on the actuating member, whereby the undefinable actuating feeling in the case of a switch with the conventional elastic cap does not occur. Furthermore, an attenuation of the switching noises produced when actuating the actuating member is brought about, so that the ergonomics for the user are improved in the case of the switch according to the invention.

In spite of the sealing against contaminants, the switch according to the invention can be of a smaller design than a previous protected switch. Finally, the user can easily see that the switch is protected against ingress of contaminants, even if the switch is fitted into the wall of an electrical item of equipment. Nevertheless, the esthetics for the switch are improved in comparison with the conventional protective caps.

BRIEF DESCRIPTION OF THE DRAWINGS

Exemplary embodiments of the invention are described in more detail below and are represented in the drawings, in which.

DETAILED DESCRIPTION OF THE PREFERRED EMBODIMENTS

Figure 1:
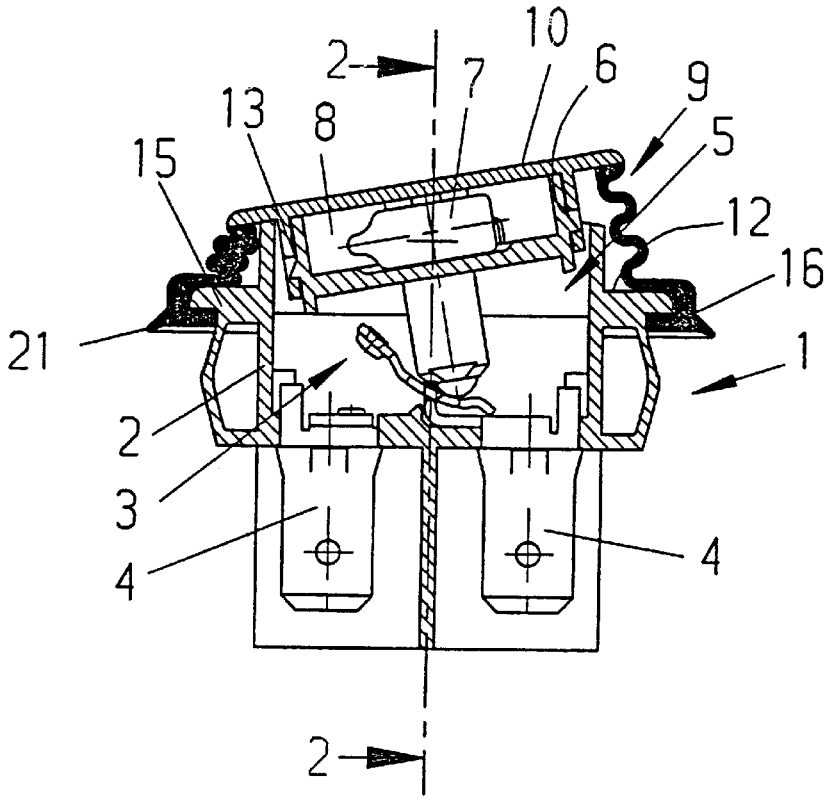
FIG. 1 shows a longitudinal section through an electrical switch.

In FIG. 1, an electrical switch 1 with a housing 2 can be seen. In the housing 2 there is a contact system 3, to which electrical terminals 4 protruding from the housing 2 lead on the underside. On the upper side of the housing 2 there is an opening 5, in which an actuating member 6 protruding partly out of the housing 2 is movably arranged. By means of the actuating member 6, which the user actuates manually, a switching action on the contact system 3 is made possible.

Figure 3:
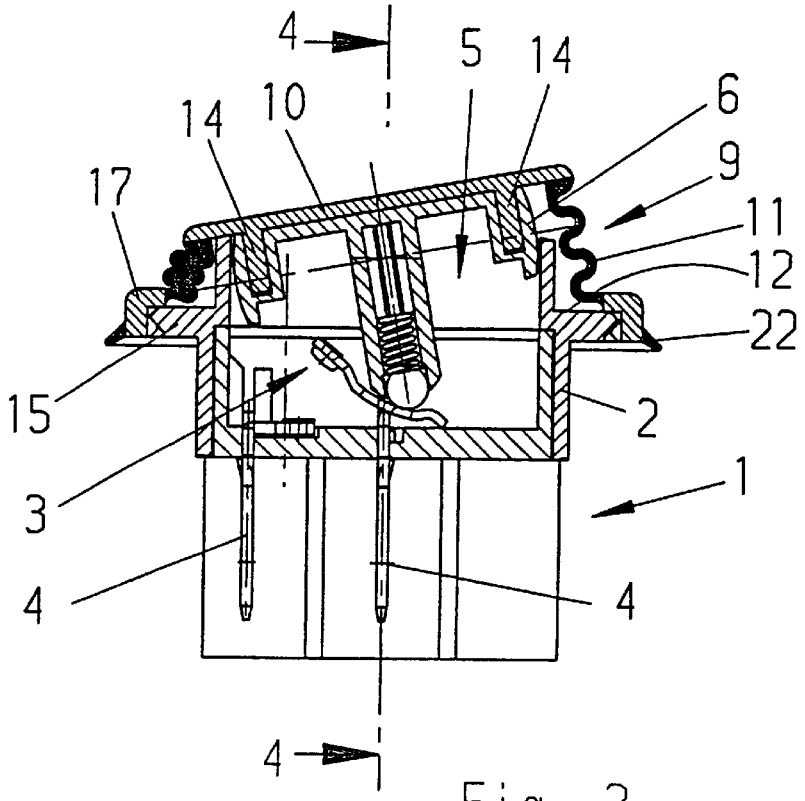
FIG. 3 shows a longitudinal section through an electrical switch according to a further embodiment.

As seen from FIG. 1, the present case concerns a rocker switch, the actuating member 6 of which is designed as a rocker. In particular, the rocker switch can be illuminated, for which purpose a lighting element 7 is arranged in a chamber 8 of the rocker. An unilluminated rocker switch is shown in FIG. 3. The switch may also be designed as a pressure switch with an actuating member or the like designed as a plunger.

To prevent ingress of contaminants, such as water, dust or the like, into the interior of the housing 2, a cap 9 is arranged on the upper side of the housing 2. The cap 9 covers the part of the actuating member 6 protruding out of the housing 2 as well as the opening 5 in the housing 2. Furthermore, the cap 9 is designed in such a way that it allows the movement of the actuating member 6 for switching the contact system 3.

Figure 2:
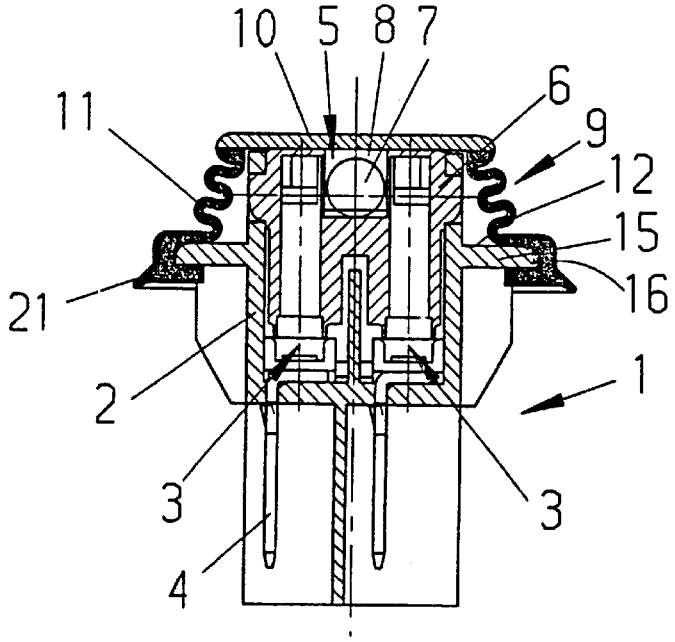
FIG. 2 shows a section along the line 2—2 from FIG. 1.

As FIGS. 1 and 2 reveal, the cap 9 has a flat cover, which is designed essentially in the manner of a planar surface 10, as well as a sleeve-like part 11. The planar surface 10 of the cover and also the housing 2 consist of a hard material. A rigid plastic, for example polycarbonate, is suitable as the material. The planar surface 10 may be of a rectangular, square, circular, oval or similar shape. If the switch 1 can be illuminated, at least part of the planar surface 10 of the cover is designed such that it is at least partly transparent to light in the visible spectral range. The sleeve-like part 11 is designed in the manner of a bellows and consists of a flexible material. An elastic plastic, for example a thermoplastic elastomer, is suitable as the material. If appropriate, the sleeve-like part 11 may also consist of rubber or the like. The sleeve-like part 11 is fastened by its one end along a peripheral edge on the side of the planar surface 10 of the cover facing away from the user. The other end of the sleeve-like part 11 protrudes laterally beyond the surface 10 of the cover. This protruding other end of the sleeve-like part 11 is arranged on a region 12 of the housing 2 surrounding the opening 5.

The planar surface 10 of the cover is arranged on the part of the actuating member 6 protruding out of the opening 5 in such a way that the actuating member 6 can be moved via the side of the planar surface 10 of the cover facing the user. Since the planar surface 10 consists of a hard material, to be precise preferably of a rigid plastic, the user has the same switching feeling as when the actuating member 6 is actuated directly without a cap 9. On the other hand, on account of the design of the sleeve-like part 11 in the manner of a bellows, the cap 9 does not prevent the movement of the actuating member 6 during switching. Nevertheless, the cap 9 ensures reliable protection against ingress of contaminants at the opening 5 into the interior of the housing 2.

As FIG. 1 reveals, the planar surface 10 of the cover can be fastened on the actuating member 6 by means of catch and/or snap hooks 13. The snap and/or catch hooks 13 are located on the side of the planar surface 10 facing away from the user and can be designed such that they protrude from the planar surface 10. For fastening, the cap 9 is placed over the actuating member 6 and the planar surface 10 is then clipped onto the actuating member 6. It goes without saying that other ways of fastening the planar surface 10 on the actuating member 6 are also possible, for example by means of lugs, detents or latching surfaces. A further way of fastening by means of pins 14, which engage with a force closure and/or form fit into corresponding receptacles on the actuating member 6, is also shown in FIG. 3.

For further fastening of the cap 9 on the housing 2 there is on the housing 2 a flange face 15, which runs all around along the region 12 surrounding the opening 5. In a way corresponding to a first embodiment, shown in FIGS. 1 and 2, the other end of the sleeve-like part 11, facing the housing 2, is designed as an elastic receptacle 16 corresponding to the flange face 15. On account of this design, the receptacle 16 can be slipped over the flange face 15 for arranging and fastening the sleeve-like part 11 on the housing 2.

Figure 4:
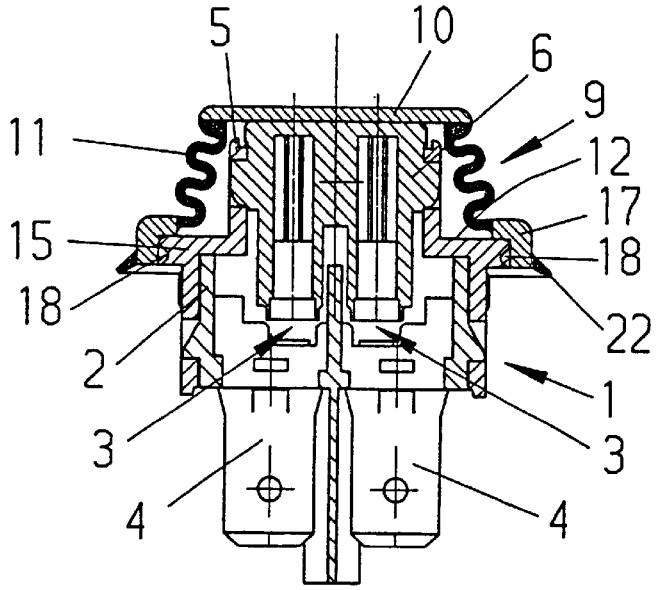
FIG. 4 shows a section along the figure line 4—4 from FIG. 3.

In a second embodiment, which can be seen in more detail in FIGS. 3 and 4, the other end of the sleeve-like part 11, facing the housing 2, is fastened on a frame-like base 17 of a hard material, such as a rigid plastic, for example polycarbonate or the like. The frame-like base 17 is in turn designed as a receptacle corresponding to the flange face 15, so that, for arranging the sleeve-like part 11 on the housing 2, the frame-like base 17 can be fitted onto the flange face 15. For secure fastening of the frame-like base 17 on the housing 2, the base 17 has detents 18, which can be seen in FIG. 4 and with the aid of which clipping of the base 17 onto the flange face 15 is made possible.

In a particularly preferred development, one end of the sleeve-like part 11 is molded on the planar surface 10 of the cover, to be precise along the peripheral edge on the side of the planar surface 10 facing away from the user, for fastening in the manner of a two-component part. As a result, secure sealing of the cap 9 is achieved and production of the cap 9 is itself likewise simplified. Equally, in the second embodiment, the other end of the sleeve-like part 11, facing the housing 2, may be likewise molded on the base 17 in the manner of a two-component part. The design as a two-component part is appropriate in particular whenever the planar surface 10 and/or the base 17 consists of a hard thermoplastic material and the sleeve-like part 11 consists of a thermoplastic elastomer.

Figure 5:
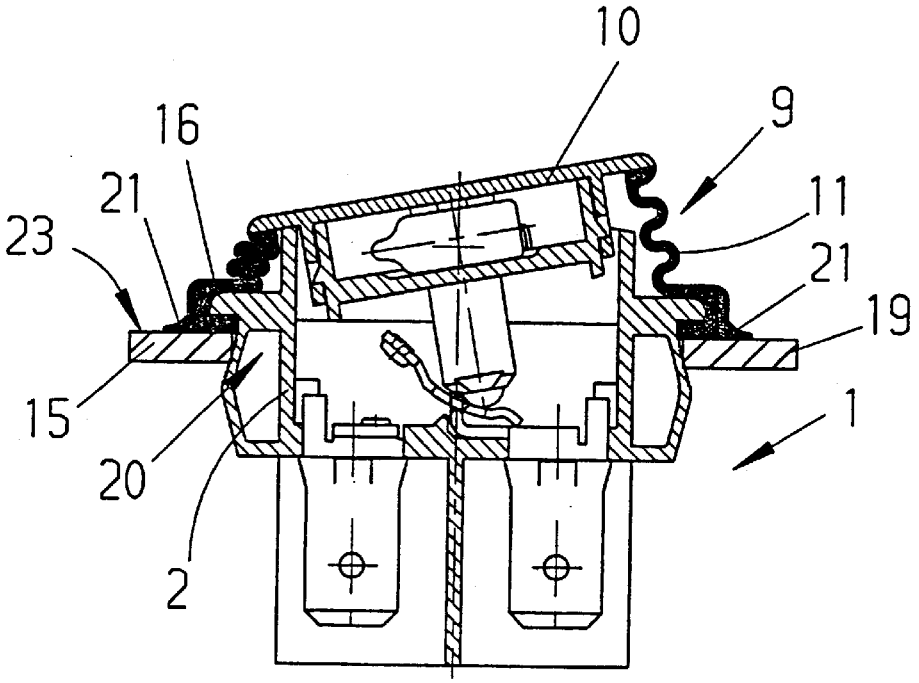
FIG. 5 shows the electrical switch designed in a way corresponding to the embodiment according to FIG. 1 and mounted in an item of electrical equipment.
Figure 6:
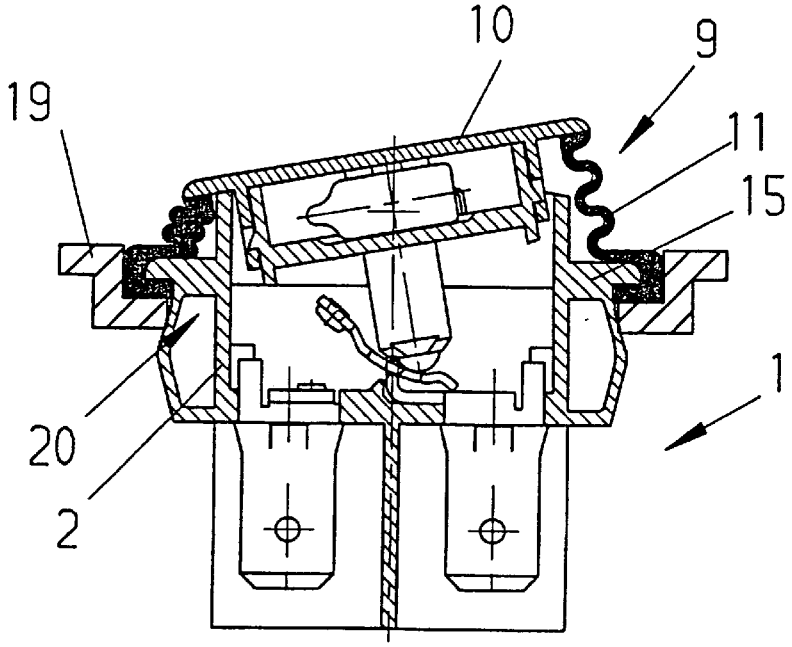
FIGS. 6 to 12 show various further embodiments for the mounting of the switch in an item of electrical equipment.
Figure 7:
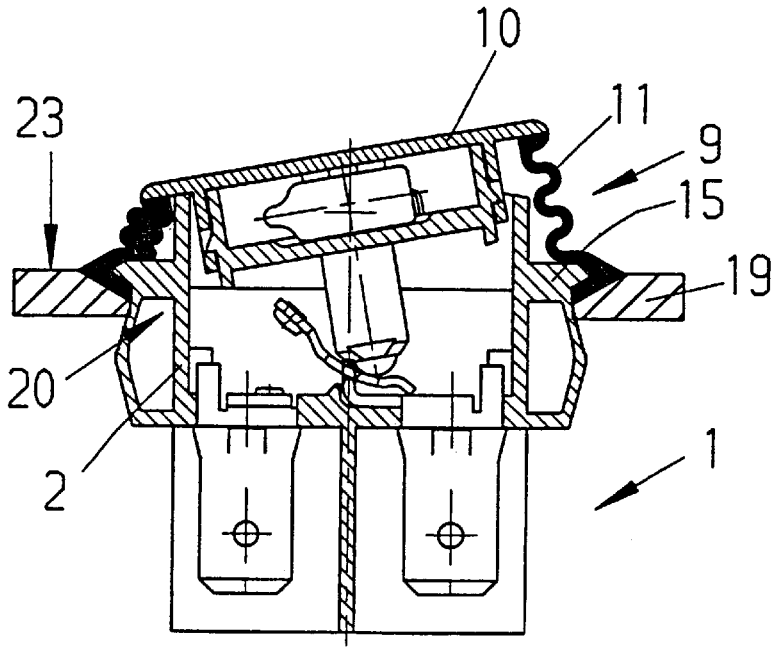

The switch 1 may, for example, be arranged in an equipment wall 19 of an electrical item of equipment, as schematically shown in FIG. 5. For this purpose, in the equipment wall 19 there is a mounting opening 20, into which the switch 1 with its housing 2 can be fitted. It is then appropriate to use the cap 9 at the same time to seal the mounting opening 20 in such a way that ingress of contaminants into the electrical equipment is effectively prevented. For this purpose, a sealing lip 21 may be additionally provided on the receptacle 16 of the sleeve-like part 11, as can be seen in FIGS. 1 and 2 for the first embodiment. In the second embodiment, a sealing lip 22 may be located on the base 17, which FIGS. 3 and 4 reveal in more detail. If the switch 1 is fitted together with the cap 9 into the mounting opening 20, the sealing lip 21, 22 comes to bear against the equipment wall 19 with a sealing effect, as clearly shown by FIG. 5.

Several ways of configuring the mounting of the switch 1 in the equipment wall 19 can be seen in FIGS. 5 to 12. As likewise revealed there in more detail, the other end of the sleeve-like part 11 protrudes laterally beyond the surface 10 of the cover in such a way that the sleeve-like part 11 is not completely concealed by the planar surface 10 of the cover, as a result of which the sleeve-like part 11 is at least still partly visible to the user even after the switch 1 has been fitted into the electrical equipment.

Figure 8:
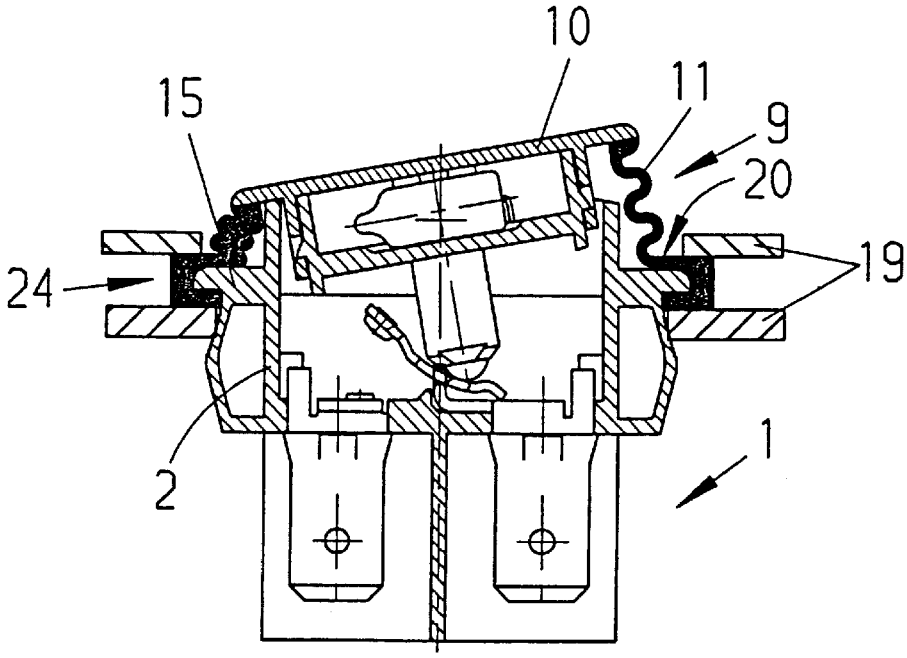
Figure 9:
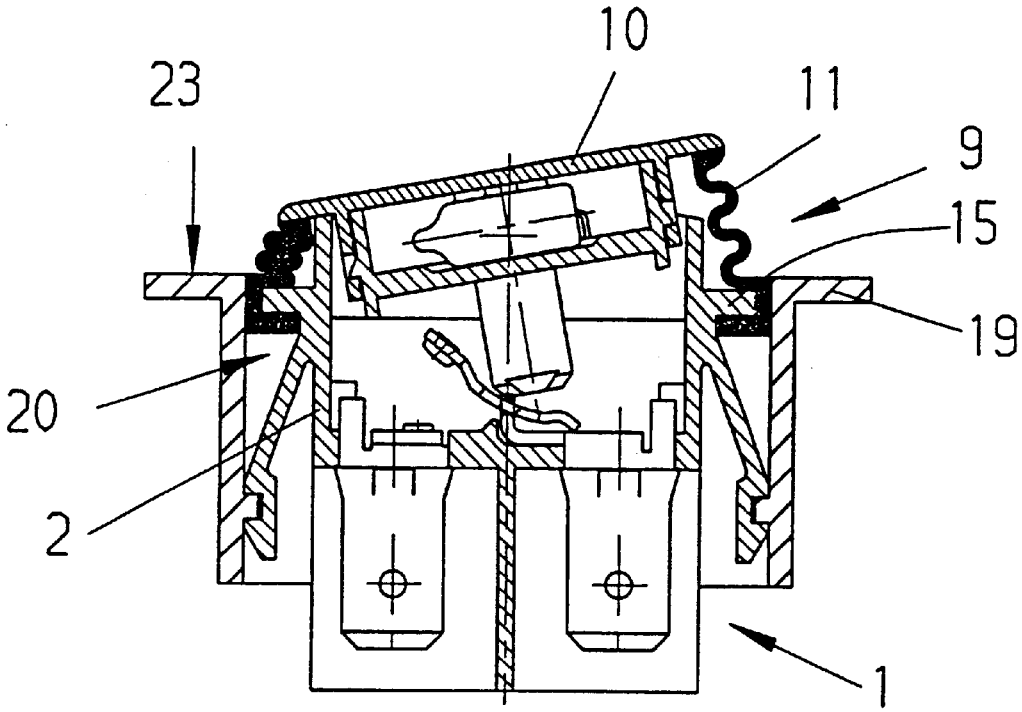
Figure 10:
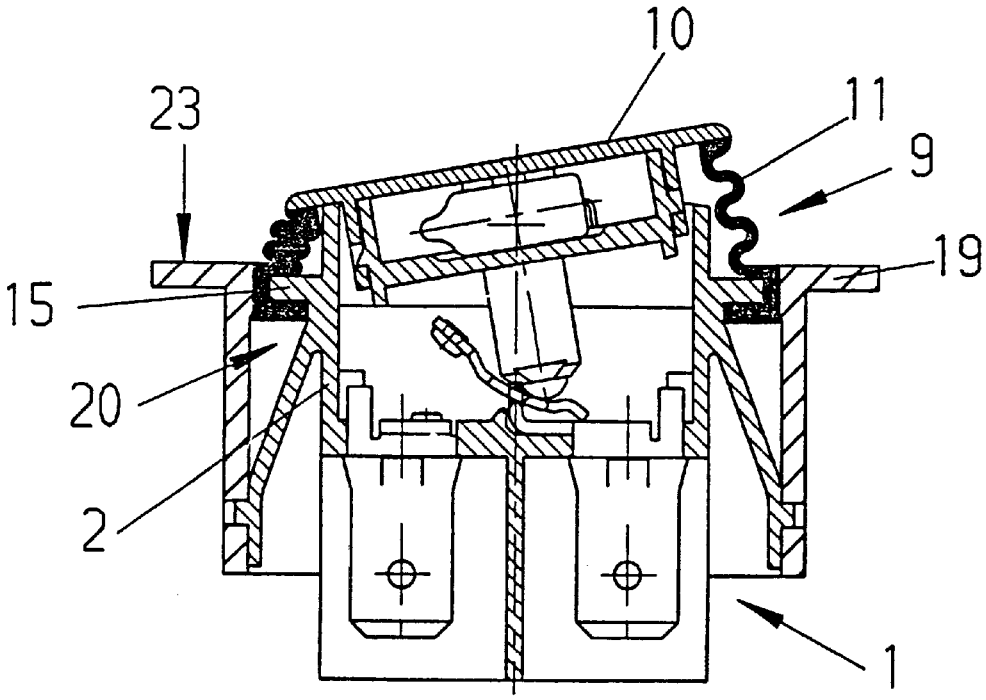
Figure 11:
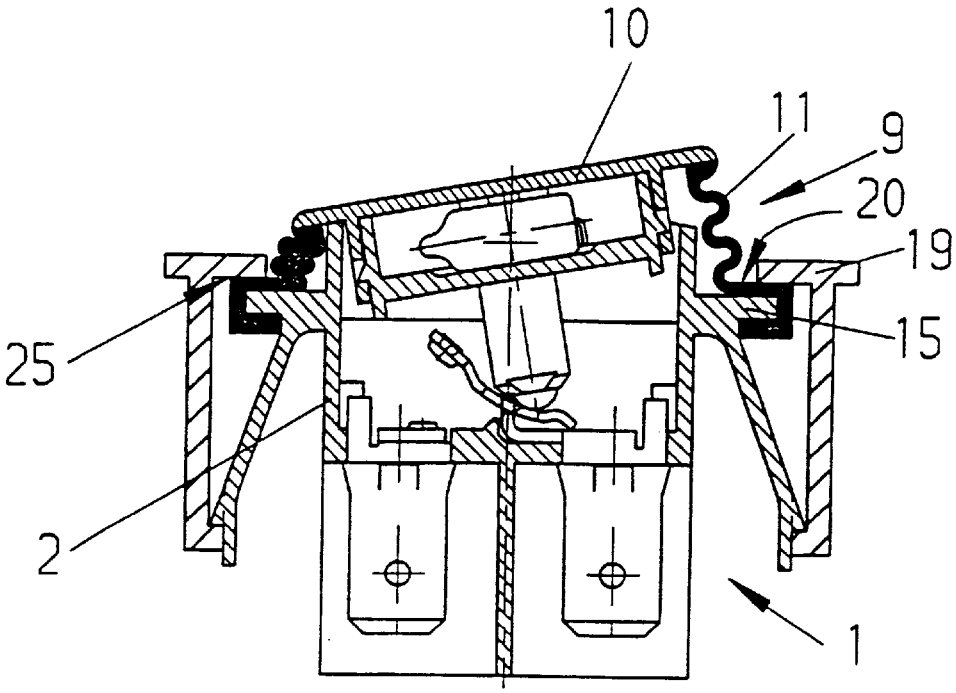
Figure 12:
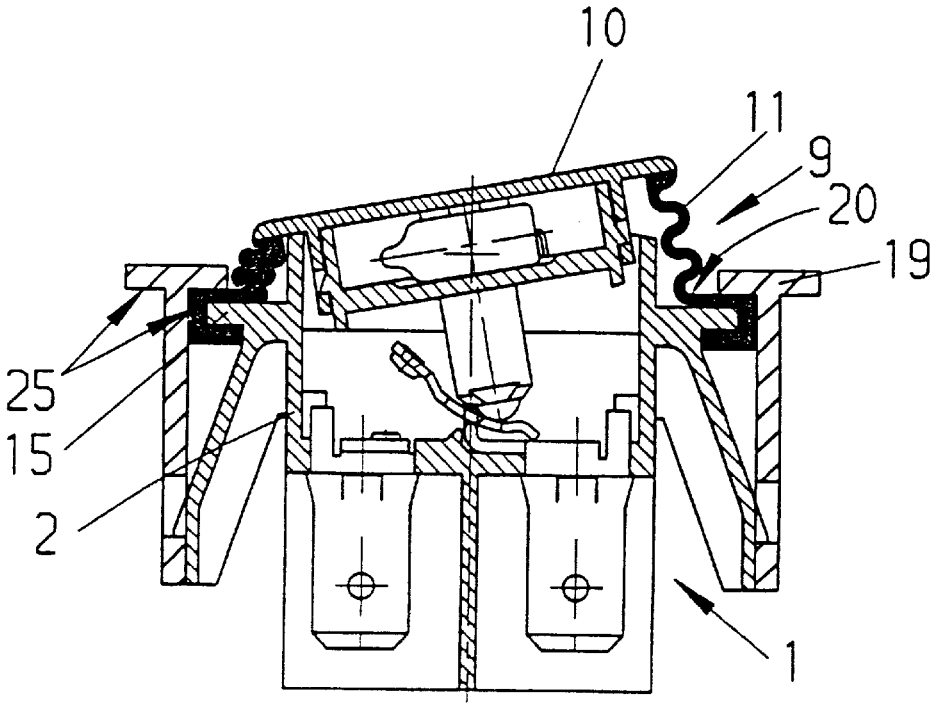

In a way corresponding to FIG. 5, the switch 1 is fitted into the mounting opening 20 located in the equipment wall 19 in such a way that the flange face 15 of the housing 1 bears with a sealing effect against the outer side 23 of the equipment wall 19 by means of part of the cap 9, to be precise in particular of the receptacle 16 of the sleeve-like part 11. In the embodiments according to FIGS. 6 to 10, the switch 1 is fitted into the mounting opening 20 in such a way that the flange face 15 of the housing 2 is located essentially inside the mounting opening 20. According to FIG. 6, the flange face 15 is essentially flush with the equipment wall 19. According to FIG. 7, the flange face 15 protrudes slightly beyond the outer side 23 of the equipment wall 19. In a way corresponding to FIGS. 9 and 10, the flange face 15 is arranged slightly set back with respect to the outer side 23 of the equipment wall 19. In FIG. 8, the equipment wall 19 is configured as a double wall, so that the flange face 15 engages in the intermediate space 24 of the equipment wall 19. Finally, in a way corresponding to FIGS. 11 and 12, the switch 1 is fitted into the mounting opening 20 in such a way that the flange face 15 of the housing 2 bears against the inner side 25 of the equipment wall 19. The latter arrangement is particularly preferred, since the actuating member 6 is then located together with the cap 9 essentially flush in the equipment wall 19, which allows particularly ergonomic actuation of the actuating member 6 for the user. Differently designed catch arms on the housing 2 for fastening the switch 1 in the mounting opening 20 are also shown in FIGS. 9, 10, 11 and 12.

The invention is not restricted to the exemplary embodiments described and presented. Rather, it also comprises all developments which can be carried out by a person skilled in the art within the scope of the idea of the invention. For instance, the invention can be used not only on the rocker switches described but also, as already mentioned, on pressure switches or the like.

What is claimed is:

1. An electrical switch comprising:

a housing, a contact system located in the housing, an actuating member arranged in an opening on the housing, said actuating member partly protruding out of the housing and acting on the contact system with a switching effect, and a cap which covers the part of the actuating member protruding out of the housing as well as the opening in the housing and allows the movement of the actuating member, the cap having a cover of a hard material and a sleeve-like part of a flexible material, the sleeve-like part including a bellows, and the cover being arranged on the part of the actuating member protruding out of the opening in such a way that the actuating member is movable via the cover, wherein the cover includes a planar surface for engagement by a user and a rear surface parallel to the planar surface, in that one end of the sleeve-like part is fastened along a peripheral edge on the rear surface, and the other end of the sleeve-like part protrudes beyond the surface of the cover, the protruding other end of the sleeve-like part being arranged on a region of the housing surrounding the opening.

2. The electrical switch according to claim 1, wherein the material for the planar surface of the cover and/or for the housing is a rigid plastic and the material for the sleeve-like part is an elastic plastic.

3. The electrical switch according to claim 2, wherein the rigid plastic is a polycarbonate.

4. The electrical switch according to claim 2, wherein the elastic plastic is a thermoplastic elastomer.

5. The electrical switch according to claim 1, wherein one end of the sleeve-like part is molded on the planar surface of the cover for fastening as a two-component part.

6. The electrical switch according to claim 1, wherein the actuating member includes a rocker.

7. The electrical switch according to claim 1, wherein the planar surface of the cover is fastened on the actuating member on the rear surface by means of protruding catch and/or snap hooks, pins, lugs, detents, or latching surfaces.

8. The electrical switch according to claim 1, wherein a flange face, which runs all around along the region surrounding the opening, is arranged on the housing and the other end of the sleeve-like part, facing the housing, includes an elastic receptacle, corresponding to the flange face, in such a way that the receptacle is slipped over the flange face for arranging the sleeve-like part on the housing.

9. The electrical switch according to claim 8, wherein a sealing lip is located on the receptacle of the sleeve-like part or on the base for coming to bear against an equipment wall, in which the switch is fitted in a mounting opening.

10. The electrical switch according to claim 8, wherein the switch is fitted into a mounting opening located on an equipment wall in such a way that the flange face of the housing bears with part of the cap against an outer side of the equipment wall.

11. The electrical switch according to claim 8, wherein the switch is fitted into a mounting opening located on an equipment wall in such a way that the flange face of the housing bears with part of the cap against an inner side of the equipment wall.

12. The electrical switch according to claim 8, wherein the switch is fitted into a mounting opening located on an equipment wall in such a way that the flange face of the housing is located with part of the cap inside the mounting opening and is essentially flush with the equipment wall.

13. The electrical switch according to claim 1, wherein a flange face, which runs all around along the region surrounding the opening, is arranged on the housing and the other end of the sleeve-like part, facing the housing, is fastened on a frame like base of a hard material, and the frame-like base includes a receptacle, corresponding to the flange face, in such a way that, for arranging the sleeve-part on the housing, the frame-like base is fitted onto the flange face.

14. The electrical switch according to claim 13, wherein the base consists of a rigid plastic, and the other end of the sleeve-like part, facing the housing, is molded onto the base as a two-component part.

15. The electrical switch according to claim 13, wherein the base has detents for clipping onto the flange face.

16. The electrical switch according to claim 1, wherein at least part of the planar surface of the cover consists of a plastic which is at least partly transparent to light in the visible spectral range, and a lighting element for illumination is located in a chamber of the actuating member.

17. The electrical switch according to claim 1, wherein the sleeve-like part consists of a plastic which is essentially opaque to light in the visible spectral range.

* * * * *